US012167773B2

(12) United States Patent
Jensen

(10) Patent No.: US 12,167,773 B2
(45) Date of Patent: Dec. 17, 2024

(54) BREATHABLE AND WATERPROOF FOOTWEAR

(71) Applicant: ECCO Sko A/S, Bredebro (DK)

(72) Inventor: Frank Jensen, Bredebro (DK)

(73) Assignee: ECCO Sko A/S, Bredebro (DK)

( * ) Notice: Subject to any disclaimer, the term of this patent is extended or adjusted under 35 U.S.C. 154(b) by 0 days.

(21) Appl. No.: 17/295,668

(22) PCT Filed: Feb. 19, 2021

(86) PCT No.: PCT/DK2021/050049

§ 371 (c)(1),
(2) Date: May 20, 2021

(87) PCT Pub. No.: WO2021/164837

PCT Pub. Date: Aug. 26, 2021

(65) Prior Publication Data

US 2022/0400809 A1 Dec. 22, 2022

(30) Foreign Application Priority Data

Feb. 19, 2020 (DK) ..... PA 2020 70095
Feb. 19, 2020 (DK) ..... PA 2020 70096
(Continued)

(51) Int. Cl.
*A43B 7/12* (2006.01)
*A43B 23/07* (2006.01)

(52) U.S. Cl.
CPC ..... *A43B 7/125* (2013.01); *A43B 7/12* (2013.01); *A43B 23/07* (2013.01)

(58) Field of Classification Search
CPC ..... A43B 7/125; A43B 7/12; A43B 23/07
(Continued)

(56) References Cited

U.S. PATENT DOCUMENTS 4,599,810 A * 7/1986 Sacre ..... A43B 23/0255 36/83
4,819,345 A * 4/1989 Mulcahy ..... A43B 7/125 36/12
(Continued)

FOREIGN PATENT DOCUMENTS

CN 108523315 9/2018
CN 109349746 2/2019
(Continued)

OTHER PUBLICATIONS

DK Search Report for corresponding DK Patent Application No. PA 202070097 dated Aug. 27, 2020, 4 pages.
(Continued)

*Primary Examiner* — Marie D Bays
(74) *Attorney, Agent, or Firm* — Lee & Hayes, P.C.

(57) ABSTRACT

A footwear includes an upper attached to a sole. The upper includes an outer layer and an inner membrane. The outer layer has a lower end. The lower end of the outer layer has an outer layer lower edge. The membrane includes a lower end of the membrane. The lower end of the membrane has a lower edge of the membrane. The membrane (MEM) is suspended within the footwear between an upper circumference of the upper and a lower anchoring circumference by means of an anchoring adhesive. The lower end of the membrane is stitched to the insole along a lower circumference. The upper circumference is lower than the top edge of the footwear.

20 Claims, 6 Drawing Sheets

(30) Foreign Application Priority Data

Figure 1:
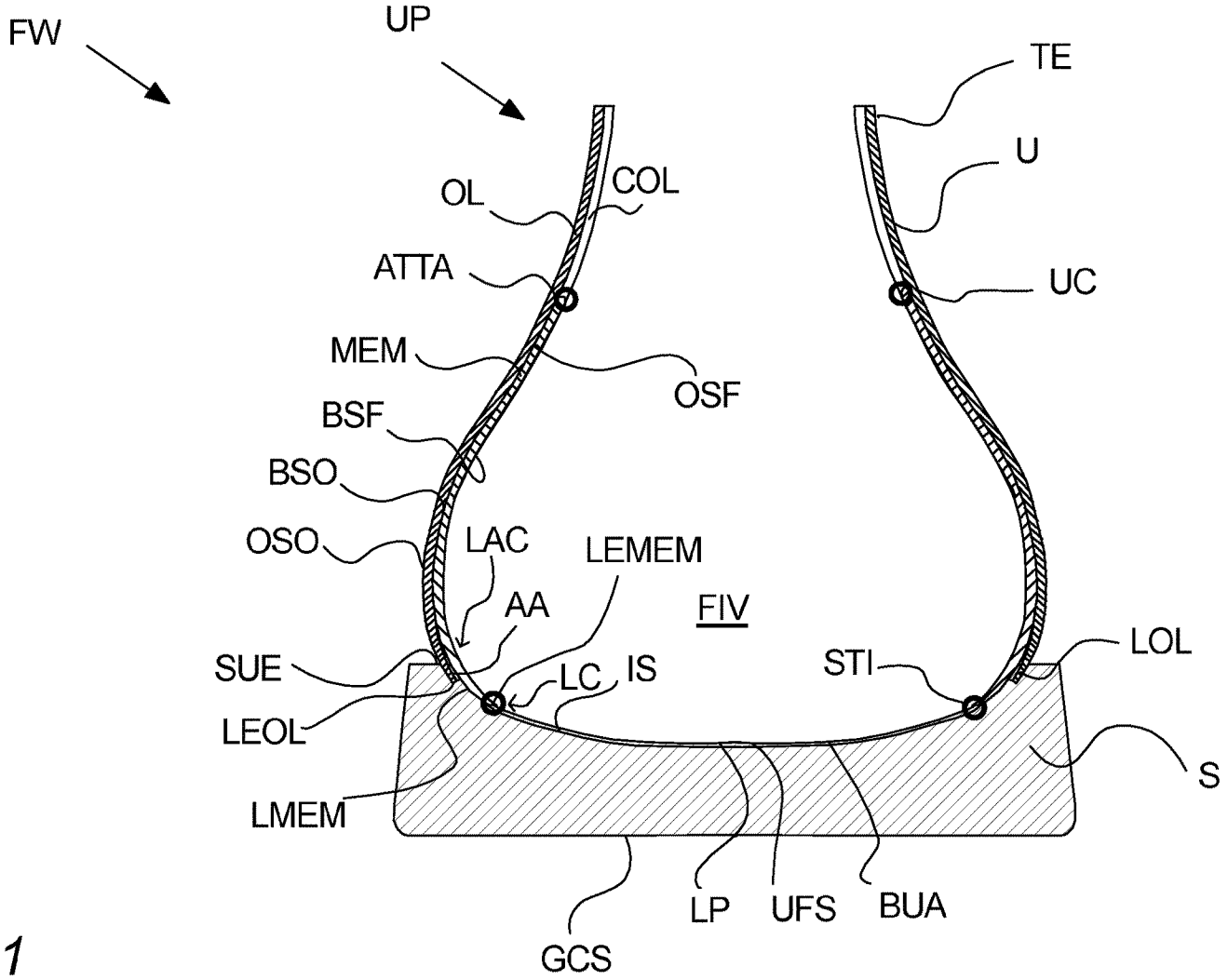

Feb. 19, 2020 (DK) ..... PA 2020 70097
Feb. 19, 2020 (DK) ..... PA 2020 70098

(58) Field of Classification Search
USPC ..... 36/3 R
See application file for complete search history.

(56) References Cited

U.S. PATENT DOCUMENTS

| | | | | |
|---|---|---|---|---|
| 4,899,465 | A * | 2/1990 | Bleimhofer | A43B 1/0072 36/12 |
| 5,285,546 | A * | 2/1994 | Haimerl | A43B 7/125 12/142 E |
| 5,289,644 | A | 3/1994 | Driskill | |
| 5,433,021 | A * | 7/1995 | Mahler | B29D 35/061 12/142 E |
| 5,505,011 | A * | 4/1996 | Bleimhofer | A43B 7/125 36/4 |
| 5,732,479 | A * | 3/1998 | Pavelescu | A43B 7/125 36/12 |
| 5,766,704 | A | 6/1998 | Allen | |
| 5,992,054 | A | 11/1999 | Rauch | |
| 6,055,745 | A | 5/2000 | Endoh | |
| 6,408,541 | B1 | 6/2002 | Moretti | |
| 6,698,108 | B2 * | 3/2004 | Pavelescu | A43B 7/125 36/55 |
| 6,845,572 | B1 | 1/2005 | Haimerl | |
| 7,013,580 | B2 * | 3/2006 | Morlacchi | A43B 7/125 36/12 |
| 7,219,446 | B1 * | 5/2007 | Haimerl | A43B 9/12 36/12 |
| 8,245,416 | B2 | 8/2012 | Polegato Moretti | |
| 11,324,278 | B2 * | 5/2022 | Polegato Moretti | A43B 7/087 |
| 2002/0040537 | A1 * | 4/2002 | Polegato Moretti | B29D 35/061 36/12 |
| 2003/0041474 | A1 | 3/2003 | Keidel | |
| 2004/0045189 | A1 | 3/2004 | Polegato Moretti | |
| 2005/0055843 | A1 * | 3/2005 | Morlacchi | A43B 7/125 36/44 |
| 2005/0081281 | A1 | 4/2005 | Hannon et al. | |
| 2005/0138845 | A1 * | 6/2005 | Haimerl | B29D 35/061 36/55 |
| 2007/0101610 | A1 | 5/2007 | Haimerl | |
| 2007/0180731 | A1 | 8/2007 | Polegato Moretti | |
| 2009/0188134 | A1 | 7/2009 | Polegato Moretti | |
| 2012/0151806 | A1 * | 6/2012 | Polegato Moretti | B29D 35/142 36/3 B |
| 2013/0047471 | A1 | 2/2013 | Liang | |
| 2013/0055598 | A1 | 3/2013 | Wiener | |
| 2013/0160223 | A1 | 6/2013 | Bier et al. | |
| 2013/0239442 | A1 * | 9/2013 | Plegato Moretti | A43B 7/125 36/3 A |
| 2014/0283411 | A1 * | 9/2014 | Nabernik | A43B 7/087 36/83 |
| 2015/0082669 | A1 | 3/2015 | Peikert | |
| 2017/0188660 | A1 | 7/2017 | Polegato Moretti et al. | |
| 2017/0258182 | A1 | 9/2017 | Takahashi | |
| 2019/0053577 | A1 | 2/2019 | Burch | |
| 2019/0098961 | A1 | 4/2019 | Chang | |
| 2020/0046064 | A1 | 2/2020 | Polegato Moretti | |
| 2022/0000214 | A1 * | 1/2022 | Hansen | A43B 7/125 |
| 2022/0378153 | A1 * | 12/2022 | Jensen | A43B 7/125 |
| 2022/0386741 | A1 * | 12/2022 | Jensen | A43B 13/38 |
| 2022/0400809 | A1 | 12/2022 | Jensen | |
| 2023/0091843 | A1 * | 3/2023 | Jensen | A43B 23/0255 |
| 2023/0354961 | A1 | 11/2023 | Jensen | |

FOREIGN PATENT DOCUMENTS

| | | |
|---|---|---|
| DE | 4443002 | 6/1996 |
| DE | 20102347 U1 | 4/2001 |
| DE | 202016106142 | 12/2016 |
| EP | 1046352 | 10/2000 |
| EP | 1124457 | 8/2001 |
| EP | 1195100 | 4/2002 |
| EP | 1825996 | 2/2007 |
| EP | 2446764 | 3/2008 |
| IT | PD20110395 | 6/2013 |
| WO | WO0024279 | 10/1999 |
| WO | WO0044252 | 8/2000 |
| WO | WO0112003 | 2/2001 |
| WO | WO2012028206 | 3/2012 |
| WO | WO2013087324 | 6/2013 |
| WO | WO2017070483 | 4/2017 |

OTHER PUBLICATIONS

Additional DK Search Report for corresponding DK Patent Application No. PA 202070098 dated Aug. 31, 2020, 4 pages.
DK Search Report for corresponding DK Patent Application No. PA 202070098 dated Dec. 4, 2020, 2 pages.
Additional DK Search Report for corresponding DK Patent Application No. PA 202070095, dated Dec. 11, 2020, 2 pages.
DK Search Report for corresponding DK Patent Application No. PA 202070096 dated Aug. 14, 2020, 4 pags.
DK Search Report for corresponding DK Patent Application No. PA 202070095 dated Aug. 24, 2020, 4 pages.
DK Search Report for corresponding DK Application No. PA 202070097 dated Aug. 27, 2020, 4 pages.
DK Search Report for corresponding DK Patent Application No. PA202070096 dated Aug. 14, 2020, 4 pages.
PCT Search Report for corresponding PCT International Application No. PCT/DK2021/050048 dated May 7, 2021, 13 pages.
PCT Search Report for corresponding PCT International Application No. PCT/DK2021/050049 dated May 10, 2021, 12 pages.
PCT Search Report for corresponding PCT International Application No. PCT/DK2021/050047 dated May 3, 2021, 6 pages.
PCT Search Report for corresponding PCT International Application No. PCT/DK2021/050045 dated May 4, 2021, 7 pages.
PCT Seach Report for corresponding PCT International Application No. PCT/DK2021/050046 dated May 4, 2021, 6 pages.
"Strobel VEB200-1 Mechanic's Instructions", dated Oct. 15, 2018, retrieved from the internet at «https://www.manualslip.com/manual/1654796/Strobel-Veb200-1.html?page=12&term=stitch+length&selected=1», p. 8.
"Strobel VTD410EV Operating Instructions Manual" dated Jul. 6, 2018, retrieved fromt he internet at «https://www.manualslib.com/manual/1652601/Strobel-Vtd410eb.html?page=26#manual», p. 22.
Office Action for U.S. Appl. No. 17/295,633, mailed on Sep. 7, 2023, Jensen, "Cemented Waterproof Footwear", 12 Pages.
Office Action for U.S. Appl. No. 17/295,592, mailed on Nov. 7, 2023, Frank Jensen, "Waterproof and Breathable Footwear Comprising a Toe Cap and a Heel Cap", 19 pages.
Office Action for U.S. Appl. No. 17/800,835, mailed on Dec. 21, 2023, Frank Jensen, "A Waterproof and Breathable Footwear," 16 pages.

* cited by examiner

BREATHABLE AND WATERPROOF FOOTWEAR

This Application claims priority to PCT Application No. PCT/DK2021/050049, filed Feb. 19, 2021, which claims priority to DK Patent Application No. PA 2020 70095, filed Feb. 19, 2020, to DK Patent Application No. PA 2020 70096, filed Feb. 19, 2020, to DK Patent Application No. PA 2020 70097, filed Feb. 19, 2020, and to DK Patent Application No. PA 2020 70098, filed Feb. 19, 2020, the contents of each of which is incorporated herein by reference.

BACKGROUND

The invention relates to a breathable and waterproof footwear and a method of providing such article of footwear.

SUMMARY

The invention relates to a footwear comprising an upper attached to a sole the upper comprising an outer layer and an inner membrane wherein the outer layer comprises a lower end, the lower end of the outer layer having an outer layer lower edge, wherein the membrane comprises a lower end of the membrane, the lower end of the membrane having a lower edge of the membrane, wherein the membrane is suspended within the footwear between an upper circumference of the upper and a lower anchoring circumference by means of an anchoring adhesive, wherein the lower end of the membrane is stitched to the insole along a lower circumference, and wherein the upper circumference is lower than the top edge of the footwear.

In an embodiment of the invention the lower end of the membrane is further attached so the sole (s).

According to the invention, is it possible to use less than or at least as little membrane as state of the art footwear while at the same time obtaining a secure sealing between the membrane and a waterproof sole or at least a waterproof part of the sole without the use of gaskets or other additional sealing layers or objects as the sealing may now be obtained by means of a the cement applied for cementing the sole to the upper or the sole material subjected to the upper by direct injection.

The large insole reduces the need for how long the lower end of the membrane needs to be extended towards the insole and thereby reduces the costs related to membrane, whereas the loose suspension means that the lower end of the upper, is as flexible as possible and thereby easing the relative expensive and difficult process of strobel sewing the lower end of the membrane to the insole. The extension of the lower end of the membrane below the lower edge of the outer layer also facilitates an easier sealing in the sense that this sealing may be performed as above described by means of injected sole material or by means of cement applied for the attachment of a premanufactured sole to the upper, but the effective sealing is also obtained as the membrane (non-laminated to the outer layer) at the lower end is more flexible and easier to handle during strobel sewing considering that the insole is not likely to be folded and that the membrane is the structure which needs to be stretched during sewing due to the process of fitting a membrane which in principle has a larger circumference that shorter circumference of the insole.

The use of anchoring adhesive instead of laminating the membrane to the outer layer has the benefit by itself that the membrane is easier to handle and stretch during the strobel sewing compared e.g. to an end to end stitched of a membrane/outer-layer laminate to an insole. Such a sewing is difficult to make smooth and a supplementary separate sealing may typically be necessary, e.g. in the form of a gasket.

It should be noted that loosely suspended in the present context simply means that the membrane is not continuously laminated (homogeneous or in patterns) to the outer layer but the main fastening of the membrane to the upper is performed along discrete lines in the top and to the sole at the lower end of the membrane by cement to the sole or by injecting the sole to the membrane. Furthermore, the membrane is fastened to the insole by stitching.

An advantage of an embodiment of the invention may be that the lower end of the membrane may be sealed to the sole by means of the adhesive cementing the upper to the sole or by means of sole material injected by a DIP process to the upper.

This sealing may according to a preferred embodiment of the invention by obtained without the use of further sealings members, such as gaskets etc.

Thus, in an embodiment of the invention, the footwear is gasket free.

In an embodiment of the invention the lower end of the membrane is stitched to the insole along the lower circumference without perforating the lower end of the outer layer.

In a preferred embodiment of the invention, the insole is thus attached by stitching to the lower end of the membrane without stitching the insole to the lower end of the outer layer and thereby avoiding stitching in the outer layer.

In an embodiment of the invention the lower end of the membrane projects further below the lower edge of the outer layer towards the insole.

In an embodiment of the invention the sole of the footwear defines a sole upper edge at the outside of the footwear defining a transition between the sole and the outer layer.

In an embodiment of the invention the sole is cemented to the insole, the lower end of the membrane and the lower end of the outer layer.

In an embodiment of the invention the sole is attached by direct injection process to the insole, the lower end of the membrane and the lower end of the outer layer.

In an embodiment of the invention the cross-section of the lower end of the membrane curved towards the insole.

The cross-section is here referring to a cross-section view at a given point around the stitching between the insole and the lower end of the membrane.

In an embodiment of the invention the cross-section of the lower end of the membrane and the insole is curved towards the stitching between the insole and the lower end of the membrane.

The meaning of the term curved in the present context is opposite to a perpendicular transition between the lower end of the membrane and the insole or a substantially flat transition, i.e. having the lower end of the membrane and the insole in the same plane.

The curvature of the cross-section of the lower end of the membrane towards the insole is concave as seen from inside the footwear.

The curvature of the cross-section of the lower end of the membrane and the insole towards the stitching between the insole and the lower end of the membrane is concave as seen from inside the footwear.

The concave curving thereby approximates the shape of a user's foot.

Curved in the present context is understood with reference to an approximation to the cross-section of a (user's) foot. The use of a perpendicular transition or a flat transitions has some benefits but approximating the lower end of the membrane and the insole curvature in the produced footwear to a foot of a wearer of the footwear may have some ergonomic benefits but it moreover makes is possible to save membrane at the same time instead of needing a larger membrane (smaller insole) when the transition is substantially flat or alternatively in the perpendicular case facing the difficult requirement of sealing the membrane to the "vertical" side of the sole.

According to the embodiment it is both possible to ensure the use of minimum membrane, an insole, which is as little as possible but also facilitate a sealing onto the membrane which can be performed from the bottom of the footwear without the use of sealing gaskets or other means requiring separate attention. This is both relevant for the purpose of keeping costs low and at the same time being able to handle the process during manufacture as lean and effective as possible.

The meaning of a curve in the present context is to define a cross-section which allows the lower end of the membrane to be projected gradually towards the lower end of the membrane at the opposite side of the footwear, at least across the longitudinal direction of the footwear except the heel and the toe end. This makes it possible both to attach the upper securely to the sole by cementing but at the same time use the same cementing process to reliably seal the membrane to the sole.

In an embodiment of the invention the curve is approximating an arc.

The arc may be defined as a part of a circle having a diameter of larger than 0.5 cm and a diameter of less than 200 cm, such as a diameter of larger than 1.0 cm and a diameter of less than 100 cm.

In an embodiment of the invention the membrane is attached to the upper at the upper circumference by stitching.

Suspending the membrane at the upper circumference by stitching is very advantageous in combination with the stitching to the insole as these two stitching lines (circumferences) are making is possible to secure the membrane sufficiently thereby avoiding the alternative of laminating the membrane.

In an embodiment of the invention the membrane is attached to the upper at the upper circumference by stitching to the outer layer.

In an embodiment of the invention the anchoring adhesive is attached to the inside of the outer layer at a vertical direction which is lower than the sole upper edge.

Locating the lower anchoring circumference below the sole line has several benefits, including the fact that a lowered breathability promoted or risked by this application of adhesive between the membrane and the outer is thereby made of less importance as the sole is reducing the breathability or blocking breathability anyway due to the lack of breathability of the sole material.

Membrane

In one or more embodiments the membrane may comprise a waterproof and vapor permeable functional layer. A waterproof and vapor permeable membrane including a a functional layer is well known within the art, such as commercially available GORE-TEX® from W. L. Gore & Associates, Sympatex, Cosmo, Outdry, Covestro, Respilon, Schoeller or Wilhelm.

In an embodiment of the invention, the thickness of the membrane is at least 0.01 mm, such as at least 0.1 mm, such as between 0.3 mm and 5 mm, such as between 0.5 mm and 4 mm, and such as between 1 mm and 3 mm.

In an embodiment of the invention, the thickness of the membrane is between 0.01 and 5 mm and the thickness of the insole is between 0.1 mm and 10 mm.

According to embodiments of the invention, the membrane may comprise several layers including at least one functional layer which is breathable and waterproof.

Other layers to be included or attached to the membrane includes fabric on one or both sides of the membrane layer. Such layers may e.g. be included for strength purposes, layers or treatment on the membrane for reducing the surface tensions, layers for providing color and/or e.g. a lining. In the latter case a footwear lining may thus form a part of what is referred to in the description as membrane.

In an embodiment of the invention the membrane is including at least one functional layer facilitating both water proof-ness and breathability and wherein the membrane has a protective layer facing towards the outer layer and a lining facing towards the interior of the footwear.

In an embodiment of the invention the membrane is including at least one functional layer facilitating both water proof-ness and breathability and wherein the membrane has a protective layer facing towards the outer layer and a lining facing towards the interior of the footwear and wherein the sealing of the membrane between the sole (S) and the lower end of the membrane is made between the protective layer of the membrane and the sole.

Sealing in the present context may also be referred to as suppressing water bridges as understood within the art of footwear.

In an embodiment of the invention the distance (DIST A) between the sole upper edge and the lower edge of the membrane is at least 12 mm and wherein the distance (DIST B) between the lower edge of the outer layer and the lower edge of the membrane is at least 4 mm but not greater than 25 mm.

In an embodiment the distance (DIST A) between the sole upper edge and the lower edge of the membrane is at least 12 mm and wherein the distance (DIST B) between the lower edge of the outer layer and the lower edge of the membrane is at least 5 mm but not greater than 20 mm.

In an embodiment the distance (DIST A) between the sole upper edge and the lower edge of the membrane is at least 12 mm and wherein the distance (DIST B) between the lower edge of the outer layer and the lower edge of the membrane is at least 5 mm but not greater than 15 mm.

In an embodiment of the invention the distance between the sole upper edge and the lower edge of the outer layer is at least 5 mm, such as at least 6 mm.

In an embodiment of the invention the distance between the sole upper edge and the lower edge of the outer layer is between 5 mm and 25 mm, such as between 5 mm and 20 mm, such as between 6 mm and 15 mm.

In an embodiment of the invention the lower end of the membrane is sealed to the sole directly by cementing or by direct injection of the sole onto the membrane.

The sole preferably includes/forms an outsole or is attached to an outsole or other relevant sole members or layers.

In an embodiment of the invention the height of the anchoring adhesive is at least 4 mm.

In an embodiment of the invention the height of the anchoring adhesive is between 4 to 20 mm, such as between 5 to 15 mm, such as between 5 to 10 mm.

The lower anchoring adhesive should preferably have the aforementioned height and be unbroken along the complete anchoring adhesive circumference, including the anchoring optionally formed by means of adhesive onto the toe cap and/or the heel cap.

In the present context it should be noted that it is desired keeping the height of the anchoring adhesive as low as possible to ease the strobel sewing and the thereby facilitating a reliable sealing with few stich challenges and folding of the membrane along the circumference of the insole, in particular in the toe and heel end.

In an embodiment of the invention the horizontal distance (H DIST) between the lower edge of the outer layer and the lower edge of the membrane is shorter than the distance between the lower edge of the outer layer and the lower edge of the membrane along the lower end of the membrane.

In an embodiment of the invention the horizontal distance (H DIST) between the lower edge of the outer layer and the lower edge of the membrane is at least 10% shorter than the distance between the lower edge of the outer layer and the lower edge of the membrane along the lower end of the membrane.

In an embodiment of the invention the horizontal distance (H DIST) between the lower edge of the outer layer and the lower edge of the membrane is at least 20% shorter than the distance between the lower edge of the outer layer and the lower edge of the membrane along the lower end of the membrane.

In an embodiment of the invention the horizontal distance (H DIST) between the lower edge of the outer layer and the lower edge of the membrane is at least 30% shorter than the distance between the lower edge of the outer layer and the lower edge of the membrane along the lower end of the membrane.

In an embodiment of the invention the horizontal distance in the horizontal plane between the lower edge of the membrane and a point in the middle of the insole is at least 5% shorter than the corresponding distance along the curvature of the insole.

In an embodiment of the invention the horizontal distance in the horizontal plane between the lower edge of the membrane and a point in the middle of the insole is at least 8% shorter than the corresponding distance along the curvature of the insole.

In an embodiment of the invention the horizontal distance in the horizontal plane between the lower edge of the membrane and a point in the middle of the insole is at least 10% shorter than the corresponding distance along the curvature of the insole.

In an embodiment of the invention the horizontal distance in the horizontal plane between the lower edge of the membrane and a point in the middle of the insole is at least 15% shorter than the corresponding distance along the curvature of the insole.

Moreover, the invention relates to a method of manufacturing a footwear comprising an upper attached to a sole the upper comprising an outer layer and an inner membrane, wherein the outer layer comprises a lower end, the lower end of the outer layer having an outer layer lower edge, wherein the membrane comprises a lower end of the membrane the lower end of the membrane having a lower edge of the membrane, wherein the membrane is suspended within the footwear between an upper circumference of the upper and a lower anchoring circumference by means of an anchoring adhesive, wherein the lower end of the membrane is stitched to the insole along a lower circumference, wherein the upper circumference is lower than the top edge of the footwear and wherein the membrane is suspended between the upper circumference and the lower anchoring circumference preferably to have little or no adherence to the outer layer.

In an embodiment of the invention the upper is lasted prior to attaching the sole to the upper and wherein the sole is attached to the upper by a direct injection process and wherein the direct injection process when performed attaches to the lower end of the membrane around the circumference of the lower end of the membrane thereby sealing the membrane to the circumference of the sole.

The sole is preferably waterproof and made by waterproof material(s) to the extent that is able to seal the membrane when attached to it during cementing or direct injection.

In an embodiment of the invention the upper is lasted prior to attaching the sole to the upper and wherein the sole is attached to the upper by a direct injection process and wherein the direct injection process when performed attaches to the lower end of the membrane around the circumference of the lower end of the membrane thereby sealing the membrane to the circumference of the sole.

The sole is preferably waterproof and made by waterproof material(s) to the extent that is able to seal the membrane when attached to it during cementing or direct injection.

In an embodiment of the invention both the lower end of the outer layer and the insole is curved during the lasting process to as to make the lower end of the membrane available for cementing of a sole from below.

Wherein both the lower end of the outer layer and the insole is curved during the lasting process to as to make the lower end of the membrane available for cementing of a sole from below and wherein the distance between the lower edge of the outer layer and the lower edge of the membrane (DIST B) is between 4 and 15 mm, such as between 4 and 12 mm, such as between 5 and 11 mm.

This disclosure also describes an embodiment of a method for the manufacturing of a footwear.

The lining material may be a material with strong moisture absorption capacity maximizing the comfort dry inner environment of the footwear.

The backing fabric may be constructed of a material knitted from synthetic fibers such as polyamide fibers.

The important part of the overall membrane is that part of the membrane facing towards the sole, here the backing fabric, is sealable with sole material, adhesive or other appropriate sealant applied onto the surface.

Insole

In an embodiment of the invention, the thickness of the insole (IS) is at least 0.1 mm, such as at least 0.5 mm, such as at least 1 mm, such as between 0.1 mm to 10 mm, such as between 0.5 mm to 9 mm, such as between 1 mm to 8 mm, such as between 2 mm to 7 mm, such as between 3 mm to 6 mm.

In an embodiment of the invention, the insole (IS) is a strobel sole.

In an embodiment of the invention, the insole (IS) comprises a non-woven material.

In an embodiment of the invention, the insole (IS) comprises a woven material.

In an embodiment of the invention, the insole (IS) material comprises foam.

Stitches

In an embodiment of the invention, the length (L) of stitches of the stitching (STI) is 1.5 mm, such as at least 3 mm, such as at least 5 mm, such as between 1.0 mm to 12 mm, such as 1 mm to 10 mm, such as 1.5 mm to 9 mm, such as 1.5 mm to 8 mm, such as 4 mm to 7 mm, such as between 5 mm to 7 mm, such as 2 mm to 4 mm, such as between 6 mm to 7 mm.

In an embodiment of the invention, the length (L) of stitches of the stitching (STI) is less than 15 mm, such as less than 12 mm, such as less than 10 mm.

In an embodiment of the invention, the length (L) of stitches of the stitching (STI) is less than 10 mm, such as less than 8 mm, such as less than 7 mm.

In an embodiment of the invention, the length (L) of stitches of the stitching (STI) is between 1-5 stitch/cm, such as between 2-4 stitch/cm, such as 3 stitch/cm.

In an embodiment of the invention, stitch width (W) of the stitching (STI) is at least 2 mm, such as at least 4 mm, such as between 2 mm to 10 mm, such 3 mm to 10 mm, such as 3 mm to 9 mm, such as 3 mm to 8 mm, such as between 5 mm to 7 mm.

In a very advantageously embodiment of the invention, the use of an insole extending wider according to embodiments of the invention, facilitates longer stitch length. Longer stitch lengths facilitate a higher flexibility of the upper, less folding and less use of thread.

If any damage is done to the membrane during stitching to the insole, such damage may be compensated/made waterproof by the adhesive applied during the process of attaching a sole to the upper.

According to embodiments of the invention, stitch length should be understood as the length from one stitch top to the next stitch top in the stitching direction.

The stitch length may also be measured as stitches pr. cm.

According to embodiments of the invention, stitch width should be understood as the total width from top to top in the transverse direction of the stitching. For further explanation of stitch length L and stitch width please refer to the description the associated figures.

Stitches Other

In an embodiment of the invention, the stitching (STI) attaches the lower end of the membrane (LMEM) to the insole (IS) by stitches without perforating the lower end of the outer layer (LOL).

In an embodiment of the invention, the stitching (STI) is sealed by a waterproof sealing forming at least a part of a waterproof bottom sealing the insole (IS) of the footwear.

Stitching Techniques

In an embodiment of the invention, the stitches of the stitching are made as two thread stitches.

In an embodiment of the invention, the stitches of the stitching are made as single thread stitches.

In an embodiment of the invention, stitching only uses one thread.

According to embodiments of the invention, the strobel sewing technique may only use an upper thread.

Upper thread and top thread may be used interchangeable according to embodiments of the invention. Lower thread and bottom thread may be used interchangeable according to embodiments of the invention.

According to embodiments of the invention, the stitches of the stitching may also be made as sewing techniques such as e.g. zig-zag, tacking, topstitching, edgestitching, staystitching and/or understitching.

In an embodiment of the invention, the stitches of the stitching are made on a strobel sewing machine.

In an embodiment of the invention, the strobel sewing machine is an overlocking or overseaming strobel stitcher.

Needle/Thread

In embodiments of the invention, the needle size may be in a size between 90 to 120. For stitching the membrane to the insole, it may be preferred to use a needle in a smaller size, such as e.g. 90.

The function of the needle is to produce holes in the material and to carry the needle thread through the material and there form a loop and then pass the needle thread through the loop.

Needles for sewing machines typical comprises and upper part, a butt and shank and a lower part comprising the shaft, front groove, eye and point. The point penetrates the material and may have a variety of forms depending on the application or material types to be sewn in. The point may have a set/spear point, a ball point or a wedge point.

According to embodiments of the invention, the thread (TH) for stitching may comprise cotton and/or polyester and the size of the thread may e.g. be a thread size between 10/3 wt to 120/3 wt, wherein a 60/3 wt thread may be preferred.

The needle and the thread should optimally fit each other by size. If the needle is too small for the thread, the thread will not pass freely through the eye and can lead to costly thread breakages in the production. Further, a too thick needle may block the penetration of PU during DIP or adhesive during cementing.

If the needle is too large for the thread there will be poor control of the loop formation which may cause slip stitches, create holes in the fabric which are too big for the stitches and may damage the fabric along the stitch line.

According to embodiments of the invention, the holes of the sewing also provide holes for the PU to penetrate during DIP or adhesive during cementing.

According to embodiments of the invention, the thread may be thinner than the threads used for other types of stitches of footwear uppers.

Adhesive Characteristics and Examples

In an embodiment of the invention, the anchoring adhesive (AA) has a melting point of at least 50 degrees Celsius, such as at least 60 degrees Celsius, such as at least 70 degrees Celsius, such as at least 80 degrees Celsius, such as at least 90 degrees Celsius, such as at least 100 degrees Celsius, such as at least 110 degrees Celsius, such as at least 120 degrees Celsius, such as at least 130 degrees Celsius, such as at least 140 degrees Celsius.

In an embodiment of the invention, the anchoring adhesive (AA) has a melting point between 30 and 200 degrees Celsius, such as between 50 and 180 degrees Celsius, such as between 70 and 160 degrees Celsius, such as between 90 and 140 degrees Celsius, such as between 100 and 120 degrees Celsius.

In an embodiment of the invention, the drying time of the anchoring adhesive (AA) is maximum 5 hours, such as 4 hours, such as 3 hours, such as 2 hours, such as 1 hour, such as 45 min, such as 30 min.

In an embodiment of the invention, the bonding time of the anchoring adhesive (AA) is less than 5 hours, such as 4 hours, such as 3 hours, such as 2 hours, such as 1 hour, such as 45 min, such as 30 min.

In an embodiment of the invention, the anchoring adhesive (AA) is a non-water-based adhesive.

In an embodiment of the invention, the anchoring adhesive (AA) is a water-based adhesive.

In an embodiment of the invention, the anchoring adhesive (AA) is heat-activated.

In an embodiment of the invention, the anchoring adhesive (AA) is a liquid.

In an embodiment of the invention, the anchoring adhesive (AA) is a film.

In an embodiment of the invention, the anchoring adhesive (AA) is a tape.

In an embodiment of the invention, the anchoring adhesive (AA) is a two-component adhesive.

In an embodiment of the invention, the anchoring adhesive (AA) is a cold glue.

In an embodiment of the invention, the anchoring adhesive (AA) is at least one of following adhesives:

epoxies, methyl methacrylates, silicone adhesives, urethanes

According to embodiments of the invention, the anchoring adhesive may be present in a continuous layer or be present as a "perforated" or non-continues adhesive layer facilitating both sufficient bonding but also breathing or some kind of moisture transport through the layers.

The application of anchoring adhesive to the leather parts may be in the form of a prelamination.

According to embodiments of the invention, the anchoring adhesive may depend on the type of material.

Adherence Process

In an embodiment of the invention, the membrane (MEM) is attached to the outer layer (OL) by an anchoring adhesive (AA) process.

In an embodiment of the invention, the anchoring adherence (AA) process comprises application of heat.

In an embodiment of the invention, the anchoring adherence (AA) process comprises application of pressure.

In an embodiment of the invention, the anchoring adherence process comprises application of heat and pressure.

Anchoring Pattern

In an embodiment of the invention, the membrane (MEM) is further attached to the lower end of the outer layer (LOL) along at least a part of the circumference of the lower end of the outer layer by means of an anchoring adhesive (AA).

In an embodiment of the invention, the membrane (MEM) is further attached to the lower end of the outer layer (LOL) along the complete part of the circumference of the lower end of the outer layer (LOL) by means of a continues an anchoring adhesive (AA).

The Outer Layer OL

In an embodiment of the invention, the outer layer (OL) is formed by a leather.

In an embodiment of the invention, the outer layer (OL) is formed by a woven or non-woven textile.

In one or more embodiments the outer layer may be an outermost layer of the upper.

The outer layer is the material facing the outer environment and may be an aesthetic pleasing material such as e.g. leather material, knitted, polymer, canvas or other types of material applied in footwear manufacturing. The outer material gives the footwear a specific look or have a specific function such as e.g. color, elasticity, stiffness, weight, or other characteristics. These materials are often liquid permeable materials.

The outer layer may be a textile layer, a leather layer, a nubuck layer, a knitted layer, a polymer and/or canvas or any type of layer that may be used as the outermost layer of a footwear upper, where the other layer may provide the outer appearance of the footwear. The outer layer may be outermost layer of the outer layer, however, the outer layer may also comprise other layers or treatments covering the other layer as an extra outer layer for e.g. strengthening, protection or aesthetical appearance.

The outer layer is generally designating a layer separated from a foot of a wearer by the breathable waterproof membrane the foot of a wearer of the footwear. The outer layer is thus designated relative to the waterproof breathable membrane whereas and further layers or structures may thus be added onto the outside of the outer layer of the footwear without compromising the understanding of what an outer layer is defined as.

The outer layer may this e.g. further comprise embossing, attachments and or logos on the side of the outer layer pointing away from the waterproof breathable membrane.

Likewise, the outer layer may further comprise a coating, impregnation or even further layers on top to the outer layer facing away from the waterproof breathable membrane Membrane In one or more embodiments the membrane may comprise a waterproof and vapor permeable functional layer. A waterproof and vapor permeable membrane including a a functional layer is well known within the art, such as commercially available GORE-TEX® from W. L. Gore & Associates, Sympatex, Cosmo, Outdry, Covestro, Respilon, Schoeller or Wilhelm.

In an embodiment of the invention, the thickness of the membrane (MEM) is at least 0.01 mm, such as at least 0.1 mm, such as between 0.3 mm and 5 mm, such as between 0.5 mm and 4 mm, and such as between 1 mm and 3 mm.

In an embodiment of the invention, the thickness of the membrane (MEM) is between 0.01 and 5 mm and the thickness of the insole (IS) is between 0.1 mm and 10 mm.

According to embodiments of the invention, the membrane may comprise several layers.

Other layers to be included or attached to the membrane includes fabric on one or both sides of the membrane layer. Such layers may e.g. be included for strength purposes, layers or treatment on the membrane for reducing the surface tensions, layers for providing color and/or e.g. a lining. In the latter case a footwear lining may thus form a part of what is referred to in the description as membrane.

Footwear Upper

According to embodiments of the invention, the footwear upper may be an upper suitable for any footwear types and may be for example a shoe, a boot, a golf shoe, an athletic shoe.

According to embodiments of the invention, the footwear upper may comprise at least two footwear parts and may be for example a toe cap and a vamp,
a vamp and a tongue,
a vamp and a quarter,
a quarter and an outer counter,
a facing and a quarter.

Insole and Sole

In an embodiment of the invention, the membrane (MEM) of the upper (U) is attached to the insole (IS) by a stitching (STI).

In an embodiment of the invention, the stitching (STI) attaches the lower end of the membrane (LMEM) to the insole (IS) by stitches without perforating the lower end of the outer layer (LOL).

In an embodiment of the invention, the stitching (STI) is sealed by a waterproof sealing forming at least a part of a waterproof bottom sealing the insole (IS) of the footwear.

In an embodiment of the invention, the attachment of the insole to the lower end of the membrane is waterproof and forming at least a part of a waterproof bottom sealing (WBS) sealing at least the insole (IS) and the lower part of the upper (U) of the footwear.

In an embodiment of the invention, the attachment of the insole to the lower end of the membrane is performed by means of stitching (STI), wherein the stitching (STI) is sealed by a waterproof sealing forming at least a part of a waterproof bottom sealing (WBS) sealing at least the insole (IS) and the lower part of the upper (U) of the footwear.

Cementing or DIP of the outer layer to the sole. The meaning of adhered in the below paragraphs are meant to include adhering by a direct injection process unless otherwise noted.

In an embodiment of the invention, at least 3 mm of the lower end of the outer layer is cemented or adhered to the sole (S).

In an embodiment of the invention, 4 to 15 mm of the lower end of the outer layer is cemented or adhered to the sole (S), such as 5 to 12 mm of the lower end of the outer layer is cemented or adhered to the sole (S).

In an embodiment of the invention, at least 4 mm of the lower end of the outer layer is roughed prior to cementing to the sole (S) and wherein the outer layer is formed by leather.

In an embodiment of the invention, at least 4 mm of the lower end of the outer layer is pre-adhered with the first adhesive (FAD) prior to cementing the upper (U) to the sole (S).

Attachment of Membrane to the Outer Layer

In an embodiment of the invention, the breathable membrane (MEM) is attached to the outer layer (OL) at least at the upper or lower end (LEND) of the footwear.

In an advantageous embodiment to the top end of the membrane is attached in a durable way, e.g. by stitching or adhesion to the outer layer while at the same being attached at the lower end of the upper to the outer layer around discreet points of the lower circumference of the membrane, discrete areas or continuously around the whole circumference. The attachment at the lower end of the membrane to the outer layer should be stitch-free so as to avoid penetration of the membrane which is difficult to seal.

In an embodiment of the invention, the breathable membrane (MEM) is attached to the outer layer (OL) at the lower end of the upper (U).

In an embodiment of the invention, the breathable membrane (MEM) is attached to the outer layer (OL) at the lower end of the upper (U) by an anchoring adhesive (AA).

In an embodiment of the invention, the breathable membrane (MEM) is also attached to the outer layer (OL) at the lower end of the upper (U) by an adhesive (LAD) adhesion around the circumference of the lower end of the outer layer (OL).

In an embodiment of the invention, the lower part of the waterproof membrane has a lower circumference area than the area of the outer material in the horizontal plane.

In an embodiment of the invention, the lower end of the outer layer (LOL) is adhered only partly around the circumference to the lower end of the membrane (LMEM).

In an embodiment of the invention, the lower end of the outer layer (LOL) is adhered around substantially the total circumference to the lower end of the membrane (LMEM).

The lower end of the membrane (LMEM) may not be the lowest end of the membrane as the membrane according to an embodiment of the invention may extend longer at the lower end than the lower end of the outer layer.

In an embodiment of the invention, the footwear upper comprises a lining.

The footwear upper may besides the waterproof membrane comprise an inner lining the comes in contact with the entire foot. The advantage of the lining is to cover the inside seams of the shoe, strengthen the footwear and lengthen the shoe's lifespan. The lining may be of different materials such as e.g. leather, fabric or a synthetic lining.

THE FIGURES

The invention will now be described with reference to the drawing where

Figure 2:
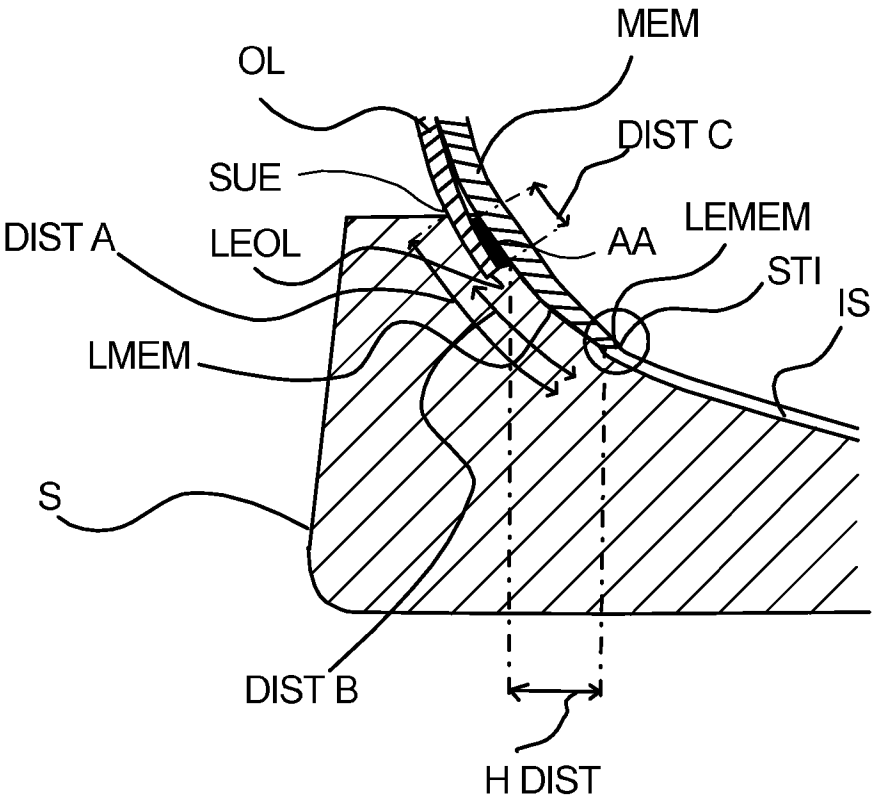
Figure 3A:
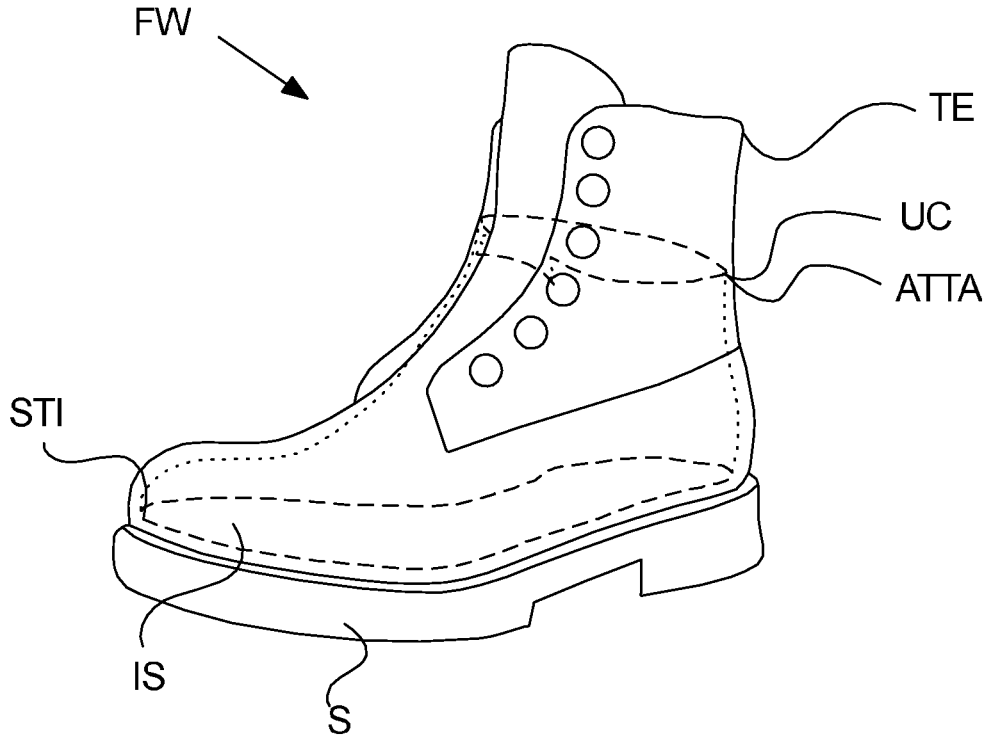
Figure 3A:
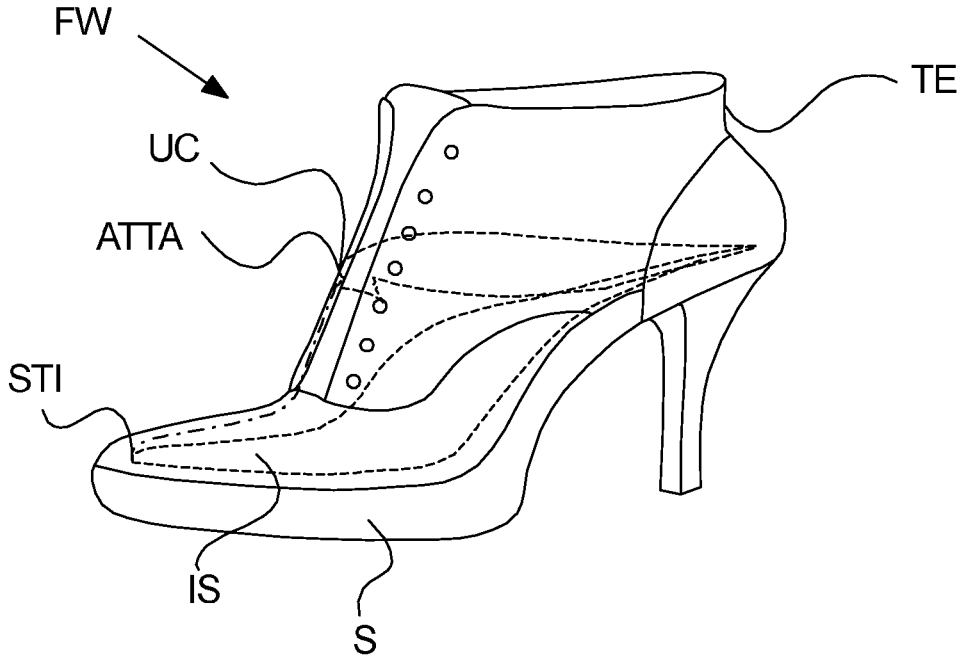
Figure 3B:
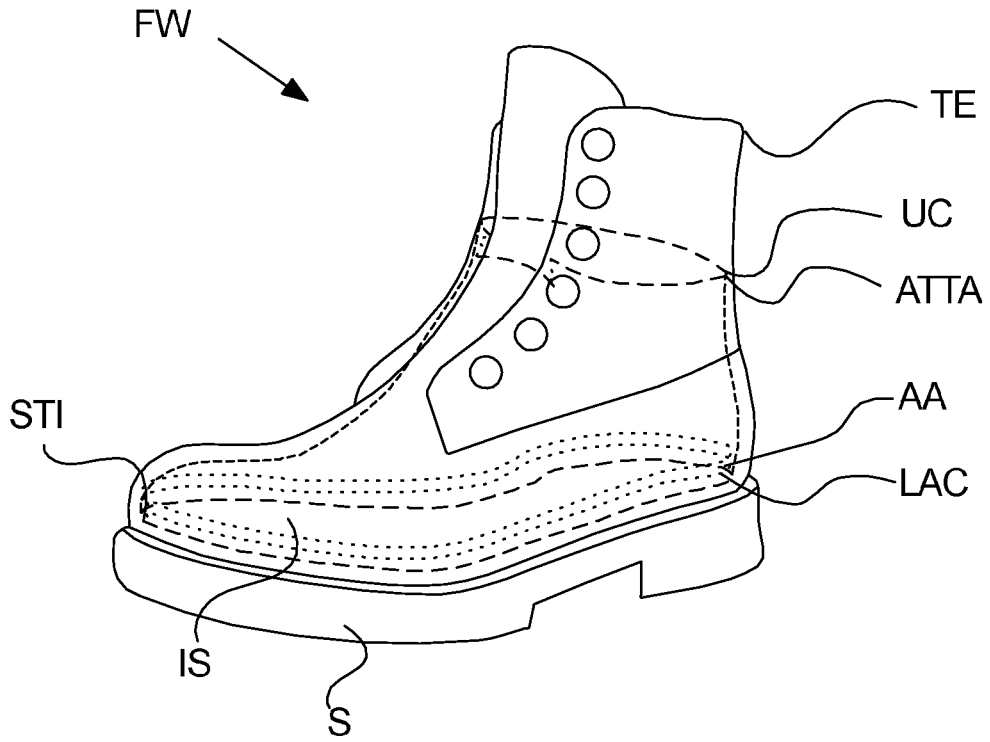
Figure 3B:
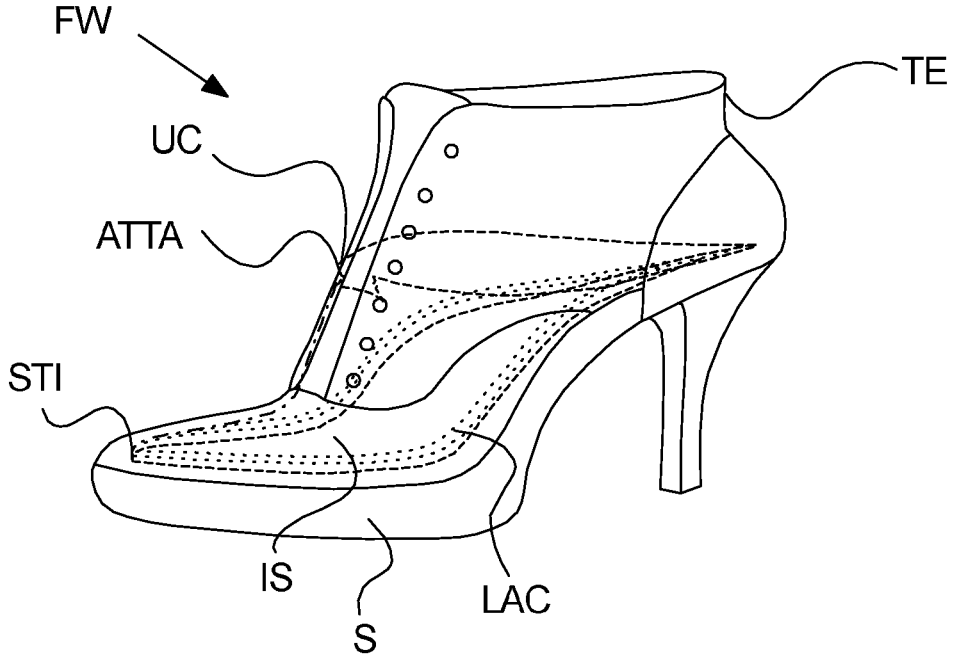
Figure 4:
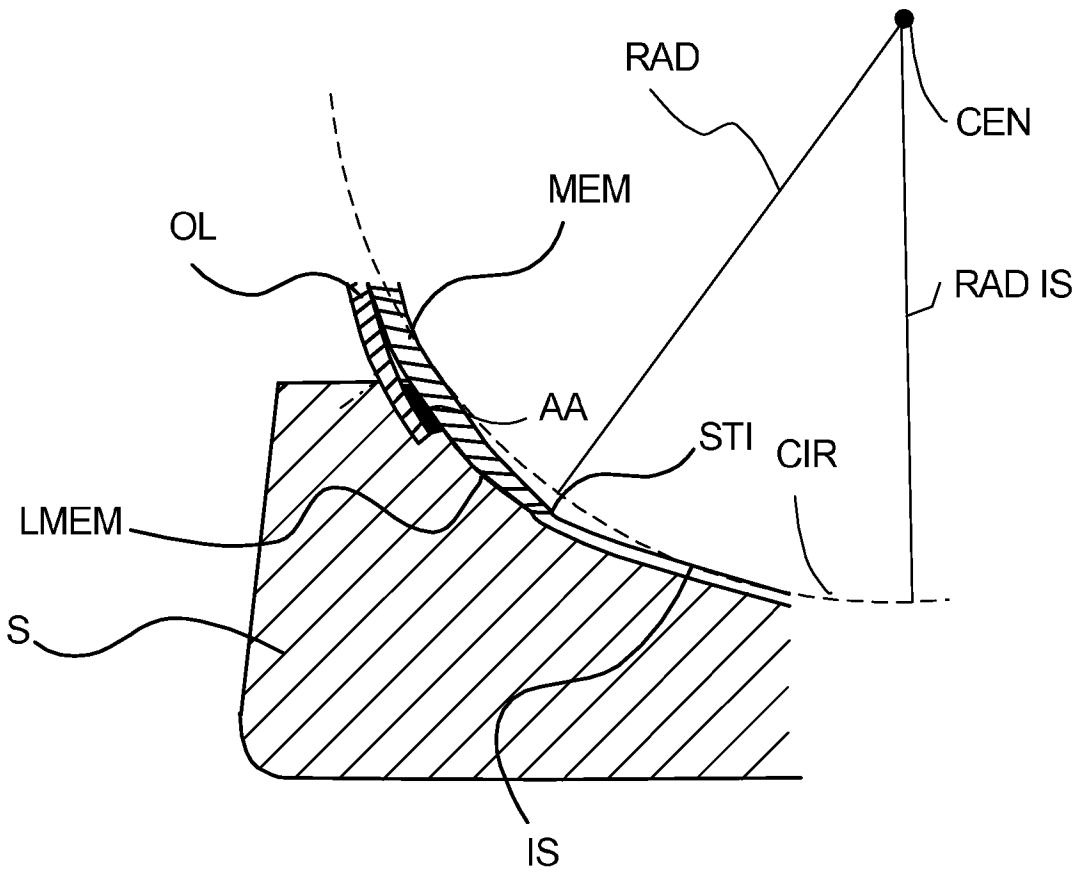
Figure 5:
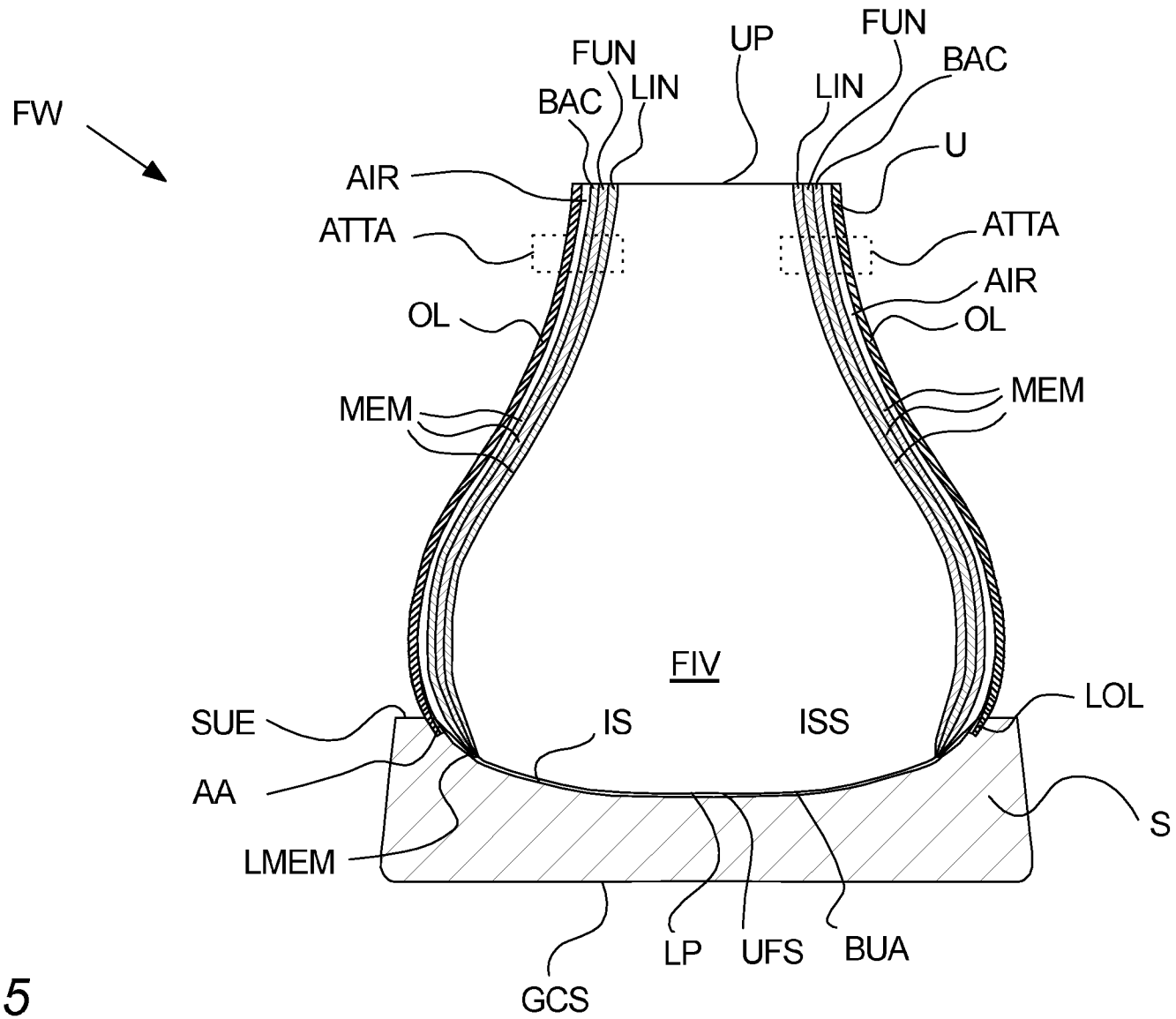

FIG. 1 illustrates a cross-section of an article of a footwear within the scope of the invention, FIG. 2 illustrates an enlarged view of a part of FIG. 1, FIGS. 3*a* and 3*b* illustrates two embodiments of the invention, FIG. 4 illustrates the enlarged view of FIG. 2 now with illustration of the curvature within the scope of embodiments of the invention and where FIG. 5 illustrates a cross-section of a further specified embodiment within the scope of the invention.

DETAILED DESCRIPTION

FIG. 1 shows a sectional view of an article of footwear FW, such as a shoe, comprising an upper U and sole S, where the upper U defines a foot insertion volume FIV. The upper U comprises an outer layer OL and a waterproof breathable membrane MEM, where the outer layer OL is the outer layer of the upper U, and the membrane MEM is positioned between the outer layer OL and the foot insertion volume FIV. The upper may further comprise a further inner lining (not shown) which may be a separate layer, e.g. of leather or textile, which is breathable. The lining may also be added as a part of the membrane, e.g. a membrane comprising one or more textiles laminated to the membrane. The membrane may also include a further layer of fabric facing towards the outer layer. This layer may in the present context serve as a reinforcing layer or a layer facilitating subsequent adhesion to other footwear layers or components.

The outer layer OL comprises two surfaces; a surface OSF that faces the foot insertion volume FIV of the upper U, and a surface OSO that is facing outwards and in the opposite direction of a surface OSF that faces the foot insertion volume FIV.

The membrane MEM comprises two surfaces; a surface BSF that faces the foot insertion volume FIV of the upper U, and a surface BSO that is facing the outer layer surface OSF.

The upper has a top edge TE, here defining the upper end of the footwear.

The upper U may comprise more than two layers, where a third, fourth or subsequent layers may be provided. The membrane MEM however should be positioned between the foot insertion volume FIV and the outer layer of the upper, in order to prevent liquids to enter the foot insertion volume. Further layers and/or attachments may of course be applied within the scope of the invention.

The upper U has an upper part UP and a lower part LP, where the lower part LP abuts the upper facing surface UFS of the sole S. The sole S has a sole upper edge SUE. The sole may comprise several parts and layers (not shown).

The sole S further has a ground contacting surface GCS, which is intended to come into contact with the ground when the article of footwear FW is worn by a user. In accordance with one or more embodiments the sole S may comprise a midsole, where the ground contacting surface GCS may be an outsole facing surface, in case there is an outsole applied between the midsole and the ground, or any other form for a sole part located between the ground and the midsole. Thus, the term ground contacting surface may be replaced by the term ground facing surface.

The outer layer OL has a lower end LOL that extends past the sole upper edge SUE of the upper surface and extends in a, preferably, downward direction towards the bottom BUA of the upper and both a lower end of the membrane LMEM and the lower end of the outer layer LOL forms a part of an area where the upper U and the sole S are joined. The lower end of the membrane is furthermore connected to an insole IS around the circumference of the insole IS. The insole may optionally be connected by means of stitching and thus forming part of the upper. This may also be referred to as a strobel stitching. It should be noted, unless otherwise specified, that the stitching is optional and other means of connecting the insole to the upper may be applied within the scope of the invention, e.g. by means of adhesion.

As may be seen in FIG. 1 the lower end of the outer layer LOL may extend a shorter distance of the upper U, than the lower end LMEM of the membrane MEM.

The illustrated footwear may in principle be manufactured as both a cemented footwear, i.e. where the sole S is cemented to a pre-manufactured upper U and a footwear manufactured by direct-injection, i.e. where the sole is molded onto the upper by a direction injection process. These two processes are known in relation to conventional footwear, but is should be noted that the method needs specific and unique modifications to be applied in the context of the present invention.

Other methods which may be applied within the scope of embodiments of the invention may include vulcanization of rubber onto the upper, casted sole or e.g. 3D printing directly onto the lower end of the upper.

In connection with the gathering of the upper with a sole, the above manufacturing methods may preferably include a roughing step if the outer layer is a top grain leather layer. At least a part of the lower end of the outer layer LOL should thus be roughed in order to e.g. attach to the cement or the DIP (DIP: Direct injection process) material to be used.

In an area where the outer layer OL and the membrane MEM overlap, they may be attached by an anchoring adhesive AA. The anchoring adhesive AA is applied for the purpose of securing the membrane to the outer layer OL around the lower end of the membrane thereby ensuring that the membrane do not fold inside the shoe. The adhesive also serves as a means for ensuring that adhesive, when sole S is attached by cementing does not progress to much between the membrane MEM and the outer layer OL. If the shoe is made by means of direct injection, the sole S would be attached to the upper by means of a direct-injection-process. In such a case, the anchoring adhesive should furthermore serve, preferably as a continuous or as a part of a continuous anchoring around the complete circumference of the lower end of the upper, thereby ensuring that the material applied for direct injection is not progressing or foaming in between the membrane and the outer layer in a undesired and unpredictable way.

The above illustrated embodiment of the invention may serve as a reference for different aspects of the present invention below. It should nevertheless be noted that the aim would overall to achieve a footwear which is waterproof above the lower end of the upper, i.e. the lower end of the membrane LMEM and the lower end of the outer layer LOL. How high such waterproofness is required may depend on the footwear design as long as it goes above the lower end of the outer layer. The outer layer OL and the membrane should also be breathable.

The waterproofness is fully required from above the lower end of the membrane and included the lower part of the upper, including the sole S. It should be noted that the waterproofness at the lower end of the footwear FW is primarily designed to keep the inside of the footwear waterproof. In other words. The combination of the outer layer and the membrane must ensure waterproofness with respect to water passing from there into the foot insertion volume FIV. It may be a little different with respect to the lower part LP of the upper in combination with the sole S, as the breathability through the sole is not and absolute requirement, but it is necessary that the water does not pass into the foot insertion volume FIV. This means that there is degree of freedom in terms of design when establishing the sole structure. A part of the sole, e.g. the lower part may thus be non-waterproof as long as the a part of the sole S or the insole IS comprise a waterproof barrier which may prevent water from passing from the outside of the footwear FW into the foot insertion volume FIV through the sole S of through the critical transition between the lower end of the membrane LMEM and the insole IS and/or the sole S.

A part of such waterproof barrier may thus in another embodiment by implemented by the application of a waterproof sole which is connected in a waterproof way the membrane of the upper.

It should thus be noted that, according to an embodiment of the invention, that both the upper U and the S/insole IS are applied as breathable and waterproof, whereas another attractive embodiment of the invention is waterproof and breathable with respect to the upper (at least the lower part of the upper) and only waterproof with respect to the sole and/or the insole.

When the sole S is attached to the upper either by cementing or by a direct a process a sole upper edge SUE is formed at this transition between the sole and the upper on the outside of the footwear The lower end of the outer layer LOL is ending at lower edge of the outer layer LEOL and the lower end of the membrane LMEN ends at a lower edge of the membrane LEMEM.

The sole is preferably waterproof in the embodiments of the invention.

The lower end of the membrane LMEM is stitched by stitching STI to the insole IS around the insole at a lower circumference LC.

In the upper part UP, the membrane is stitched to the outer layer and optionally to further footwear components, e.g. a tongue (not shown). The stitching may also be referred to as being an attachment arrangement ATTA by means of which the membrane is attached at an upper circumference UC, here by stitching. In the present embodiment, the membrane is stitched to e.g. a collar COL or a lining which e.g. may be attached to the very upper top end, e.g. by stitching and/gluing. Alternatively, and not shown, the upper end of the membrane MEM may be attached around the upper circumference by stitching directly with the outer layer OL.

The difference between the first mentioned and the last mentioned embodiment is thus that the membrane in the latter embodiment it stitched directly to the outer layer whereas the first embodiment rather is a suspension, where the membrane is stitched or attached to the outer at the top of the footwear via an intermediate member(s), thereby avoiding stitching in the top of the outer layer besides at the very top of the upper.

The upper circumference will not necessarily form an unbroken line, but is preferred that the upper circumference is an unbroken line.

Furthermore, the MEM is attached to the outer layer by an anchoring adhesive AA around a lower anchoring circumference LAC. FIG. 2 illustrates further features relates to the lower anchoring circumference and the anchoring adhesive applied, but an important feature is to suspend the membrane between the lower anchoring circumference and the upper circumference so that a complete lamination of the membrane on the outer layer is avoided. Discrete of line of anchoring adhesive may supplement the suspension.

It is further noted that the lower anchoring circumference lower should preferably ensure a continuous and non-folded attachment of the membrane to the outer layer as folding may result in a erroneous DIP or cementing process, which is in particular critical in relation to the DIP process.

In the present context an insole should be referred to as a part of the sole, which is applied to form a kind of sock for accommodating the foot of a user when the insole is stitched to the upper. This sole may by some be referred to as a strobel sole, but in the present context the insole is functionally understood as a part of the sole which is forming an anchoring interface to the sole below. It is in particular noted that the stitching of the insole in practice is performed prior to either cementing or direct injection of a sole to the upper. The stitching is not a part of these two types of processes in the present context. Thus, further sole(s) may be inserted into the footwear as basically a loose and exchangeable part of the footwear within the scope of the invention without compromising the above understanding of what an insole is.

The sole as such may comprise a combination of the insole, an outer sole and further optional sole layers or members. In the present context an insole may be regarded as a part of the sole due to its durable attachment to the sole. It is noted that such understanding may be derived from in different context, e.g. because the insole may rather be regarded as a part of the upper during manufacture of the footwear.

The lower end of the outer layer is preferably non-perforated by stitching. In other words, the footwear should not include a net stitched to the insole and the lower end of the outer layer.

By optional sole layers or members according to embodiments of the invention, should be understood as e.g. inlayers of different shape and material for the purpose of an optimized fit, softness, bouncing effect or similar to improve e.g. the fit or comfort of the footwear. Due to the construction of the footwear according to embodiments of the invention, additional waterproofing layers, such as e.g. a gasket, may not be needed as a further layer of the footwear and/or sole. In a preferred embodiment of the invention no additional gasket or member is applied for the purpose of making the transition between membrane material and insole waterproof as the waterproofness in this context preferable is provided by the sole material itself, e.g. PU applied to the upper, including the transition, during a direct injection or it may be provided by the cement or the cement combined with an outsole. In such a case, the cement is applied to the upper and the outsole during, including the transition, during the process of attaching the outsole to the upper by a cementing process.

A gasket-free approach to this waterproofness has several benefits including cost-saving in relation to manufacture and materials.

It is advantageously realized that the membrane should extend further than the outer layer at the lower end of the upper, as the desired attachment and stitching may thereby be made advantageously without perforating the part of the membrane which is overlapping the lower end of the outer layer.

By that the membrane is extending further should be understood as the membrane extends in one piece and not e.g. with an additional strip or ribbon that could be attached to the membrane. This also means that stitching is only applied in the membrane and no stitches are applied to the upper.

In an embodiment of the invention where the sole is cemented to the upper, a part of the adhesive by means of which the upper is cemented to the sole is pre-adhered to the sole and pre-adhered to the lower end of the outer layer. A further part is pre-adhered to the sole prior to the final gathering of the pre-adhered upper and the pre-adhered sole.

In an embodiment of the invention where the sole is cemented to the upper, a part of the adhesive by means of which the upper is cemented to the sole is pre-adhered to the sole and pre-adhered to both the lower end of the outer layer and the lower end of the membrane. A further part is pre-adhered to the sole prior to the final gathering of the pre-adhered upper and the pre-adhered sole.

FIG. 2 illustrates an enlarged version of a part of the cross-section of FIG. 1 here illustrated the distance between the lower edge of the outer layer LEOL and the lower edge of the membrane LEMEN as DIST B. The distance between the sole upper edge SUE and the lower edge of the membrane LEMEM is defined as DIST A. Furthermore, DIST C is defined at the height of the anchoring adhesive AA area in a cross section from the bottom of the outer layer to the top of the outer layer where anchoring adhesive has been applied. The anchoring adhesive may e.g. be pre-adhered to the outer layer and to the membrane in two separate processes and the gathered and reactivated.

FIG. 3*a* illustrates embodiments of the invention and shows examples of locations of the attachment arrangement ATTA. The attachment arrangement ATTA may be an adhesive and/or preferably a stitching and may be located with a distance from the top of the footwear upper that depends on the design of the footwear FW.

The membrane is attached to an insole IS by stitching STI and the inner sock-like membrane stitched to the insole is then cemented or DIP'ed to the sole of the footwear.

A sole provided by a DIP process it typically made of polyurethane (PUR).

A sole applied in a cemented footwear may be molded or provided by a direct injection process and the subsequently in a separate step be cemented unto the upper.

Further and as illustrated in FIG. 3*b*, the attachment of the membrane to the outer layer OL of the upper lower end may be mediated by an adhesive, such as an anchoring adhesive AA forming a lower anchoring adhesive circumference LAC.

The height of the anchoring adhesive AA as designated by DIST C in FIG. 2 should in a preferred embodiment of the invention be at least 4 mm and/or between 4-20 mm, such as between 5-15 mm. The minimum height is necessary in particular in relation to an embodiment where the sole is DIP'ed onto the upper. The lower anchoring adhesive should preferably have the aforementioned minimum height and be unbroken along the complete anchoring adhesive circumference, including the anchoring formed by means of adhesive onto the toe cap and/or the heel cap. The lower anchoring adhesive should also preferably have there aforementioned and indicated maximum heights so at to maximize the flexibility of the combined outer layer and membrane but also to secure that the breathability is optimized. Thus, a low height of the anchoring adhesive may suitably match or be comparable to the distance between the sole upper edge SUE and the lower edge of the membrane LEMEM or a little bit more, thereby obtaining that the reduction of breathability is minimized as this is already minimal due to the sealing to the sole of the upper and the lower end of the membrane.

The use of a maximum height DIST C of the anchoring adhesive makes the strobel sewing easier as the outer layer and membrane in combination is more flexible than a laminated outer layer/membrane and at the same time due to the fact that the insole is as large as possible thereby getting the insole circumference as close to the circumference of the lower edge of the outer layer LEOL as possible without bending the membrane.

Bending the membrane may have several disadvantages, such as excessive use of membrane but also resulting in a more difficult sealing or the lower end of the membrane to the sole.

FIG. 4 shows a further view of FIG. 2, but now illustrating and designating an advantageous embodiment of the invention, where the cross-section between the lower end of the membrane LMEM and the insole IS is curved. The curving may not be an exact part of a circle CIR (full circle not shown) but it approximates a circle having a radius RAD and CEN designates the center point of the circle CIR The illustration is applied to establish both and explanation of the meaning of the intended curvature and also assisting a quantization.

The curvature in the transition point of the cross-section should approximate the corresponding part of a wearer foot or this should at least apply to a large number of cross-sections of the transition around the circumference of the insole.

The approximated and illustrated curved should at least have a radius of 1 cm and less than 100 cm, such as a radius RAD of at least 1 cm and less than 80 cm, such as a radius RAD of at least 1 cm and less than 60 cm.

Furthermore, the insole should in the vertical direction at the midpoint of the insole as illustrated as RAD IS have radius RAD IS of at least 5 cm and less than 200 cm, such as a radius of at least 10 cm and less than 150 cm such as such as a radius of at least 10 cm and less than 150 cm.

It is clear from the illustration an explanation that the transition and the lower end of the membrane is easily accessible from below for the intended sealing of the membrane to the sole and at the same time the folding of membrane and/or insole is minimized thereby avoiding risks of water bridges through the intended sealing, in particular in relation to humidity/water transport via the outer layer towards the transition between the lower end of the membrane and the insole.

FIG. 5 illustrates a further embodiment within the scope of the invention and illustrates a possible sectional view of a footwear of FIG. 1. Here, the upper layers are described in more details wherein the upper U comprises an outer layer OL and with a membrane having a functional layer FUN in the middle, a protection layer e.g. a backing fabric BAC on the side facing the outer layer OL and a lining material LIN on the side away from the outer layer OL of the upper U, the lining thus forming the inside of the illustrated footwear pointed in the direction of a foot of a wearer of the footwear. The membrane may also consist of two layers or more than three layers and the layers may be in the form as a laminate attached by adhesives or other suitable means for adherence as long as the overall function with respect to waterproofness and breathability is obtained. The layers may also be more loosely attached to each other where only parts or areas of the layers are attached. The layers may also include more than one layer of membranes.

Also illustrated in FIG. 5 is a space AIR e.g. a small distance between the membrane MEM and the outer layer OL where there is no attachment of the membrane to the outer layer. This space is defined as the distance between the outer layer OL and the protecting layer of the membrane MEM. This space may vary somewhat in practice, and especially when the footwear is worn on the foot as the membrane is loosely suspended between the attachment arrangement ATTA and the anchoring adhesive AA. Of course, a few (not shown) suspension areas or points may be applied between the mentioned attachment arrangement ATTA and the anchoring adhesive AA Little or no adhesives (or similar) attaches the membrane MEM to the outer layer OL between the attachment arrangement ATTA in the top of the footwear and the anchoring adhesive AA as illustrated and explained in FIG. 1.

Outer Layer

The outer layer may be a fabric/textile layer, a leather layer, a nubuck layer, a knitted layer, polymer, canvas, or any type of layer that may be used as the outermost layer of a footwear upper, where the other layer may provide the outer appearance of the footwear.

The outer layer may be outermost layer of the outer layer, however, the outer layer may also comprise other layers or treatments covering the other layer as an extra outer layer for e.g. strengthening, color, elasticity, stiffness, weight protection or aesthetical appearance.

Examples Leather

Examples of leather types that may be used within the scope of invention may be types such as full grain or top grain leather, embossed grain leather, suede and nubuck.

In principle, the leather can derive from any source, including cow hide, horse hide, goat skin, sheep skin, kangaroo hide, reptiles, fish and the like. Even so, preferably the leather is a mammal or marsupial leather (i.e. derives from a hide from a mammal such as a cow or horse, or a marsupial such as a kangaroo). Mammal leathers are most often used.

In terms of terminology, top grain surface is the upper portion or outer covering of the animal whereas split is the under layer which is removed by splitting operation in the leather making/tanning process.

Full grain refers to top grain leather where no sanding of the surface takes place. Nubuck leathers have the surface layer removed or modified typically by a buffing process. Although the leather still has the pronounced network of natural fibers and corium structure giving the leather strength, the very top grain surface is effectively removed. The buffing process used to form nubuck leathers leaves protein fibers that produce a velvet-like feel. Artificially embossing nubuck leather can create a surface texture, but often the embossing step damages the protein fibers and undermines the velvet-like feel. Split leather is created from the fibrous part of the hide left once the top-grain has been separated from the hide, e.g. to be used as full grain or top grain leather. Split grain leather may have reduced strength as compared to comparable thicknesses of top grain leather, as the fibers tend to be more aligned.

Membrane

The outer layer may be provided as a layer that may be liquid and/or vapor permeable, as any liquids that can pass the first layer, are prevented from entering the foot insertion volume by the breathable waterproof membrane.

In one or more embodiments the membrane may comprise a waterproof and vapor permeable functional layer. A waterproof and vapor permeable membrane including a a functional layer is well known within the art, such as commercially available GORE-TEX® laminate from W. L. Gore & Associates, Sympatex, Cosmo, Outdry, Covestro, Respilon, Schoeller or Wilhelm.

The membrane may comprise a single layer of material or may comprise two or more layers of materials that are provided in a laminate, creating a functional layer assembly. The membrane may be in the form of any layer, or a laminate of layers that create a waterproof and vapor permeable layer for the upper. The vapor permeability of the layer may be adjusted in accordance with the specific use of the footwear, so that for some uses the vapor permeability may be greater than other uses, such as a hiking boot versus a casual shoe.

Other layers to be included or attached to the membrane includes fabric on one or both sides of the membrane layer. Such layers may e.g. be included for strength purposes, layers or treatment on the membrane for reducing the surface tensions, layers for providing color and/or e.g. a lining. In the latter case a footwear lining may thus form a part of what is referred to in the description as membrane.

In one or more embodiments of the invention, the membrane may be a kind of textile fabric compounded with polymer waterproof breathable materials (PTFE) membrane) plus fabric. The membrane. The membrane may also be characterized as microporous membrane expanded Teflon (polytetrafluoroethylene) more formally known as ePTFE. that is e.g. provided in a thickness of about a 0.01 mm when not including the thickness of further laminated fabrics etc.

The waterproof membrane may comprise other layers and the thickness may depend on the applied layers. In some or more embodiments of the invention, the membrane may be e.g. 0.3 mm or 0.6 mm and in other applications such as e.g. a shoe suitable for cold weather, the membrane may e.g. be 2.5 mm or thicker.

The materials of the membrane layers may vary according to the application and relevance for use, wherein a thin and flexible membrane may be relevant for e.g. athletic shoes and membranes comprising e.g. wool or similar layers may be suitable for e.g. winter boots.

Breathable membrane, waterproof membrane, breathable waterproof membrane and membrane may be used interchangeably according to the invention.

Insole

The insole is the sole that binds the footwear upper to the rest of the footwear and the material of the insole depends on the type of footwear construction and materials may be woven, non-woven, fabric, textile, canvas, leather, membrane, PU and/or foam material and may comprise additional materials for comfort or functionality.

According to embodiments of the invention, the footwear manufacturing may also be made without an insole. In this case only edging and a cord "criss-cross" the sole and the method may also be termed as "string lasting".

Insole and strobel sole may be used interchangeably according to the invention.

The insole may be stitched to the lower end of the membrane by a strobel stitching technique that may are made by a strobel stitching machine.

An example of a strobel stitching machine may e.g. be a Strobel 141-23 EV single thread overseaming machine. A needle type may e.g. be a needle type 134.

Adhesive

In embodiments of the invention, anchoring adhesive may be attached to a surface area of the membrane, and does not penetrate the membrane, either partly or fully. Thus, the water and vapor impermeability of the membrane is not affected by the adhesive. Thus, it may be important to ensure that the adhesive does not increase the water or vapor permeability of the membrane. The adhesive may provide a waterproof seal between the outer layer and the membrane of the upper.

In one or more embodiments the anchoring adhesive may extend from the lower end of the outer layer and extending along the outer layer of the total circumference of the lower end direction.

The anchoring adhesive may be an adhesive layer but may also be a weld joint, a melted joint, or any suitable adhesives that is capable of attaching and/or fixing the outer layer to the membrane.

The anchoring adhesive may be part of the outer and/or the membrane, e.g. where the outer layer may be melted to the membrane, or vice versa, or the layers may be melted to each other. Alternatively, the anchoring adhesive may be a separate member, that is positioned between the two layers, e.g. an adhesive layer.

In one or more embodiment the anchoring adhesive may extend continuously along the entire lower end of the membrane. The anchoring adhesive may be a waterproof sealing/adhesive that means that the adhesion is capable of preventing water to penetrate the foot insertion volume of the footwear.

The anchoring adhesive AA used for adhering the outer layer and membrane at the lower end as described according to the invention, may be any suitable adhesives.

Examples of anchoring adhesives may e.g. be, non-water-based adhesives, water-based adhesives, heat-activated adhesives, two-component adhesives, cold glue.

Examples of anchoring adhesives may e.g. be epoxies, methyl methacrylates, silicone adhesives, urethanes.

Examples of adhesives used according to the invention may be Locite Aquace W-01, Helmitin 11019 Helmitin GPV and/or Helmitin 49631.

The anchoring adhesive AA used according to the invention may be in various forms such as e.g. liquid, film, tape that may adhere on one or both sides.

According to embodiments of the invention, the adhesive may be present in a continuous layer or be present as a "perforated" or non-continues adhesive layer facilitating both sufficient bonding but also breathing or some kind of moisture transport through the layers.

The application of adhesive to the leather parts may be in the form of a prelamination.

According to embodiments of the invention, hot melt adhesive or hot melt glue is used to attach the sole to the upper.

Assembly

After the strobel stitching, the upper is drawn over a last LA that may be specially designed for the footwear. To make the upper flexible prior to lasting, the upper may be treated first with e.g. steaming. The treatment makes the upper easier to last and prevents the upper material from tearing.

To ensure that the sole material binds efficiently to the upper, the upper may first be roughed or scratched at the lower end of the outer layer.

LIST

FW Footwear
U Upper
S Sole
OS Outsole
FIV Foot insertion volume
OL Outer layer
MEM Membrane
OSF Outer layer surface facing the foot insertion volume
OSO Outer layer surface facing outward
BSF Membrane surface facing the foot insertion volume
BSO Membrane surface facing the outer surface OSF
UP Upper part
LP Lower part
UFS Upper facing surface of the sole
SUE Sole upper edge
GCS Sole ground contacting surface
LOL Outer layer lower end
LMEM Lower end membrane
AA Anchoring adhesive
IP Injection perforation
MFD Lateral distance
STI Stitching
IS Insole
LA Last
AC Adhesive cement
TC Toe cap
TEND Toe end
HC Heel cap
HEND Heel end
DSA Double sided adhesive
SEC1 Section 1
SEC2 Section 2
TH Thread
L Length
W Width
STFD Stitch free distance
MA Marks
MFD Mark free distance
FAD First adhesive
SAD Second adhesive
TAD Third adhesive
WBS Waterproof bottom sealing
RM Reinforcing member
LEND Lower end
ATTA Attachment arrangement
UINA Upper intermediate area
TOL Outer layer top
IOL Outer layer intermediate layer
LIN Lining material
BAC Backing material
FUN Functional layer
AIR Space
LAC lower anchoring adhesive circumference
TE Top edge
UC Upper circumference
UTEND Upper top end
ULEND Upper lower end

The invention claimed is:

1. A footwear comprising:

an upper attached to a sole, the upper comprising an outer layer and an inner membrane, wherein the outer layer comprises a lower end, the lower end of the outer layer having an outer layer lower edge, wherein the inner membrane comprises a lower end of the inner membrane, the lower end of the inner membrane having a lower edge of the inner membrane, wherein the inner membrane is attached to the outer layer at an upper circumference by stitching and/or gluing, wherein the inner membrane is attached to the outer layer at a lower anchoring circumference via an anchoring adhesive, wherein the lower end of the inner membrane is stitched to an insole along a lower circumference, wherein the upper circumference is lower than a top edge of the footwear, wherein the sole defines a sole upper edge at an outside of the footwear defining a transition between the sole and the outer layer, and wherein a cross-section of the lower end of the inner membrane is curved towards the insole, and the insole is curved towards the lower end of the inner membrane at the lower circumference.

2. The footwear according to claim 1, wherein the lower end of the inner membrane is further attached to the sole.

3. The footwear according to claim 1, wherein the lower end of the inner membrane is stitched to the insole along the lower circumference without perforating the lower end of the outer layer.

4. The footwear according to claim 1, wherein the lower end of the inner membrane projects further below the lower edge of the outer layer towards the insole.

5. The footwear according to claim 1, wherein a curve of the cross-section is approximating an arc.

6. The footwear according to claim 1, wherein the anchoring adhesive is attached to an inside of the outer layer at a vertical direction which is lower than the sole upper edge.

7. The footwear according to claim 1, wherein a distance between the sole upper edge and the lower edge of the outer layer is at least 5 mm.

8. The footwear according to claim 1, wherein the lower end of the inner membrane is sealed to the sole directly by cementing or by direct injection process of the sole onto the inner membrane.

9. The footwear according to claim 1, wherein a height of the anchoring adhesive is between 4 to 20 mm.

10. The footwear according to claim 1, wherein a horizontal distance between the lower edge of the outer layer and the lower edge of the inner membrane is shorter than a distance between the lower edge of the outer layer and the lower edge of the inner membrane along the lower end of the inner membrane.

11. The footwear according to claim 1, wherein a distance between the sole upper edge and the lower edge of the membrane is at least 12 mm and wherein a distance between the lower edge of the outer later and the lower edge of the membrane is at least 4 mm but not greater than 25 mm.

12. A footwear comprising:

an insole;

an upper including:

an outer layer having a lower end and an outer layer lower edge, and an inner membrane having a lower end and an inner membrane lower edge, the lower end of the inner membrane being stitched to the insole along a lower circumference, and the inner membrane attached to the outer layer at:

an upper circumference by stitching and/or gluing, the upper circumference being lower than a top edge of the footwear, and a lower anchoring circumference via an anchoring adhesive; and a sole attached to the upper, the sole defining a sole upper edge at an outside of the footwear defining a transition between the sole and the outer layer, wherein:

a distance between the sole upper edge and the lower edge of the membrane is at least 12 mm, a distance between the lower edge of the outer later and the lower edge of lower end of the inner membrane is at least 4 mm and not greater than 25 mm, and a cross-section of the lower end of the inner membrane is curved towards the insole, and the insole is curved towards the lower end of the inner membrane at the lower circumference.

13. The footwear according to claim 12, wherein the lower end of the inner membrane is further attached to the sole.

14. The footwear according to claim 12, wherein the lower end of the inner membrane is stitched to the insole along the lower circumference without perforating the lower end of the outer layer.

15. The footwear according to claim 12, wherein the lower end of the inner membrane projects further below the lower edge of the outer layer towards the insole.

16. The footwear according to claim 12, wherein the anchoring adhesive is attached to an inside of the outer layer at a vertical direction which is lower than the sole upper edge.

17. The footwear according to claim 12, wherein a distance between the sole upper edge and the lower edge of the outer layer is at least 5 mm.

18. The footwear according to claim 12, wherein the lower end of the inner membrane is sealed to the sole directly by cementing or by direct injection process of the sole onto the inner membrane.

19. The footwear according to claim 12, wherein a height of the anchoring adhesive is between 4 to 20 mm.

20. The footwear according to claim 12, wherein a horizontal distance between the lower edge of the outer and the lower edge of the inner membrane is shorter than a distance between the lower edge of the outer and the lower edge of the inner membrane along the lower end of the inner membrane.

* * * * *